United States Patent [19]

Fraser, Jr. et al.

[11] Patent Number: 4,938,669

[45] Date of Patent: Jul. 3, 1990

[54] SCROLL COMPRESSOR WITH AXIAL COMPLIANCY

[75] Inventors: Howard H. Fraser, Jr., Lafayette; William R. Lane, Dewitt, both of N.Y.; Shahrokh Etemad, Stratford, Conn.

[73] Assignee: Carrier Corporation, Syracuse, N.Y.

[21] Appl. No.: 299,574

[22] Filed: Jan. 23, 1989

[51] Int. Cl.[5] ..... F04C 18/04; F04C 27/00

[52] U.S. Cl. ..... 418/55; 418/57

[58] Field of Search ..... 418/55 B, 55 C, 55 D, 418/57; 29/156, 4 R

[56] References Cited

U.S. PATENT DOCUMENTS

| | | | |
|---|---|---|---|
| 4,600,369 | 7/1986 | Blain | 418/55 D |
| 4,645,437 | 2/1987 | Sakashita et al. | 418/55 D |
| 4,696,630 | 9/1987 | Sakata et al. | 418/55 D |

FOREIGN PATENT DOCUMENTS

| | | | |
|---|---|---|---|
| 62-139991 | 6/1987 | Japan | 418/55 D |

*Primary Examiner*—John J. Vrablik

*Attorney, Agent, or Firm*—David J. Zobkiw

[57] ABSTRACT

Axial compliancy is achieved in a scroll compressor by providing a fluid pressure bias to the back of the orbiting scroll. The fluid pressure bias is supplied by one or more pockets configured to combine the efficient use of the available area with ease of manufacture.

9 Claims, 4 Drawing Sheets

SCROLL COMPRESSOR WITH AXIAL COMPLIANCY

BACKGROUND OF THE INVENTION

During the compression process in a scroll compressor the pressure of the gas being compressed acts against the scroll elements tending to separate them both radially and axially. To achieve axial compliancy and axial sealing between the scroll elements, a sealed, high pressure chamber can be created between the back of the orbiting scroll and the crankcase. The chamber should not have any radial or axial interference with the Oldham coupling ring, the orbiting scroll slots, the crankcase slots and the internal bore. Such a sealed high pressure pocket can be created by using two annular O-ring grooves such that the O-rings are compressed against the back of the orbiting scroll. The major disadvantage of this design is the size limitation of the sealed high pressure gas pocket. One way of increasing the area is to enlarge the diameter of the Oldham coupling ring which results in a wider crankcase and thus a larger compressor shell diameter. Generally, the compressor shell diameter is dictated by the motor frame necessary to produce the required output and anything larger is undesirable.

SUMMARY OF THE INVENTION

The ideal configuration provides a pocket(s) with the maximum area. The available area for the pocket(s) surrounds the bearing and the boss of the orbiting scroll and has an outer boundary of a generally figure eight shape due to the coaction of the Oldham coupling ring and slots. Obviously, the available area is not of a simple configuration. Using the waist portion of the figure eight shape as the axis of symmetry, the available area can be generally defined by: (1) a pair of kidney shaped pockets; (2) a pair of crescent shaped pockets defined by two symmetrical circular cuts; or (3) a pair of symmetrical circular cuts and a central circular cut are made such that their combined outer periphery is of a figure eight shape with a central circular periphery to define an annular pocket.

It is an object of this invention to provide axial compliancy using the orbiting scroll without increasing bearing loading and without increasing the orbiting scroll outer diameter envelope.

It is another object of this invention to locate the pocket(s) in a housing which overhangs the bearing.

It is a further object of this invention to locate the bearing support close to the gas compression force by overhanging the pocket(s) and thereby minimizing the tipping moment.

It is another object of this invention to lift the orbiting scroll off the crankcase so that it rides on the seals and thereby reduces frictional forces due to the reduced loading.

It is an additional object of this invention to permit the Oldham coupling groove to be located close to the center to thereby reduce the envelope of the compressor. These objects, and others as will become apparent hereinafter, are accomplished by the present invention.

Basically, axial compliancy is achieved in an orbiting scroll without increasing the bearing loading or the outer diameter envelope of the orbiting scroll by locating one or two fluid pockets in the crankcase facing the back of the orbiting scroll and shaped to efficiently use the available space.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
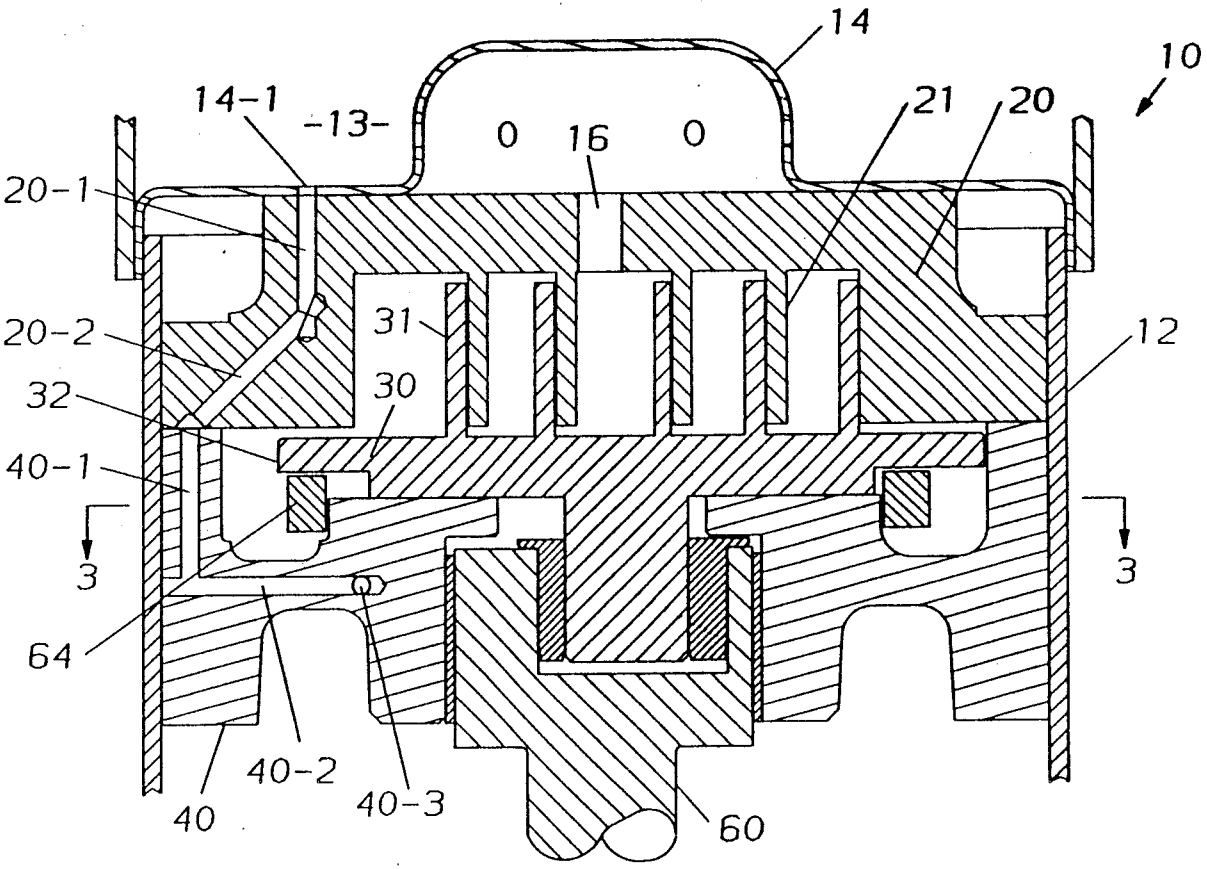
FIG. 1 is a vertical sectional view taken along line 1—1 of FIG. 3 of a portion of a scroll compressor which is in the unenergized state employing the present invention.

In the Figures, the numeral 10 generally designates a low side scroll compressor which is one in which most or all of the interior of shell 12 is at suction pressure. Muffler/separator plate 14 overlies fixed scroll 20 and defines a high pressure chamber 13 within shell 12. Crankcase 40 overhangs crankshaft 60 and is bolted or otherwise suitably secured to fixed scroll 20. Orbiting scroll 30 has a wrap 31 which is in operative engagement with wrap 21 of fixed scroll 20 while one side of plate portion 32 engages fixed scroll 20 and the other side coacts with Oldham ring 64, as is conventional.

Figure 6:
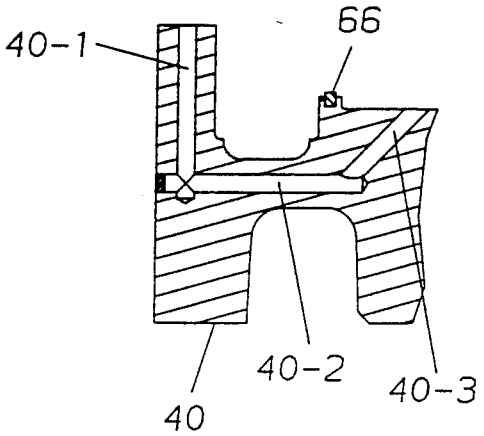
FIG. 6 is a partial sectional view taken along line 6—6 of FIG. 3.

Additionally, the other side of plate portion 32 also is in sealing engagement with seals 66 and 68 which are located in kidney shaped grooves 42 and 43 which surround pockets 50 and 52, respectively. Pockets 50 and 52 are in fluid communication with discharge pressure in high pressure chamber 13 via a flow path which is best illustrated in FIGS. 1, 3 and 6 and which serially includes passage 14-1 in muffler separator plate 14, bores 20-1 and 20-2 in fixed scroll 20, bore 40-1 and bore 40-2 which branches into bores 40-3 and 40-4 which are in fluid communication with pockets 50 and 52, respectively.

Figure 2:
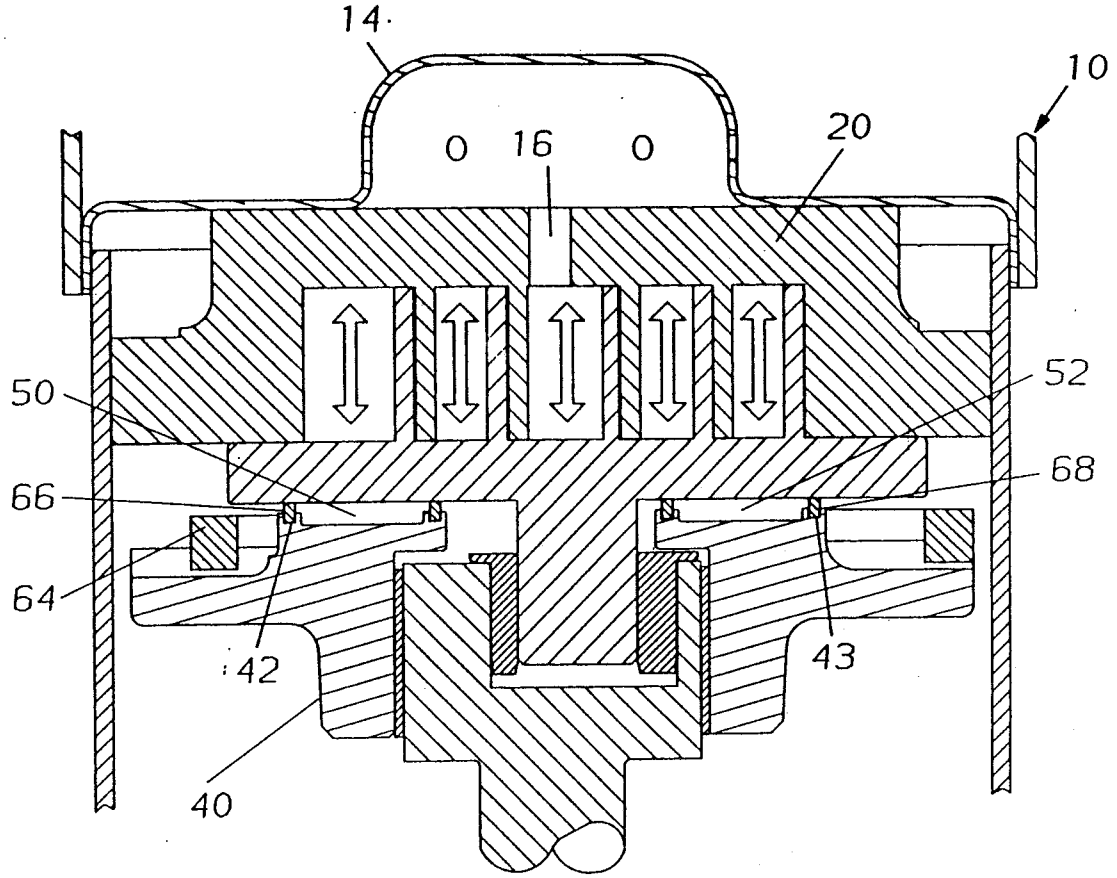
FIG. 2 is a vertical sectional view taken along line 2—2 of FIG. 3 of a portion of a scroll compressor with the axial compliance mechanism energized.

When the scroll compressor 10 is in operation, gas at discharge pressure is delivered from outlet port 16, through muffler/separator plate 14 into high pressure chamber 13 which is connected to the compressor discharge line (not illustrated). The gas at discharge pressure is supplied from chamber 13 to pockets 50 and 52 via passage 14-1 and bores 20-1 and 20-2 and 40-1 to 40-4. The high pressure fluid in pockets 50 and 52 acts on the plate 32 of the orbiting scroll 30 lifting orbiting scroll 30 off of the crankcase 40 so that orbiting scroll 30 rides on seals 66 and 68 which are held in sealing contact with orbiting scroll 30 due to their resilience as shown in FIG. 2. A small net force acting on the fixed scroll 30 tends to keep fixed scroll 20 and orbiting scroll 30 in axial contact in opposition to the separating forces produced in compressing gas due to the coaction of the fixed and orbiting scrolls while greatly reducing friction forces.

Figure 3:
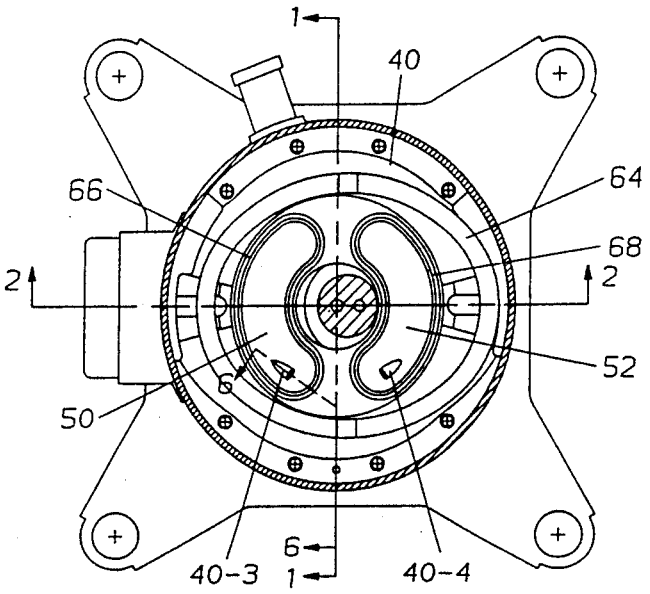
FIG. 3 is a horizontal sectional view taken along 3—3 of FIG. 1.

In machining the embodiment of FIGS. 1-3, two kidney shaped grooves 42 and 43 are machined or otherwise suitably formed in crankcase 40. Circular or other suitably shaped seals 66 and 68 may then be placed in grooves 42 and 43.

Figure 4:
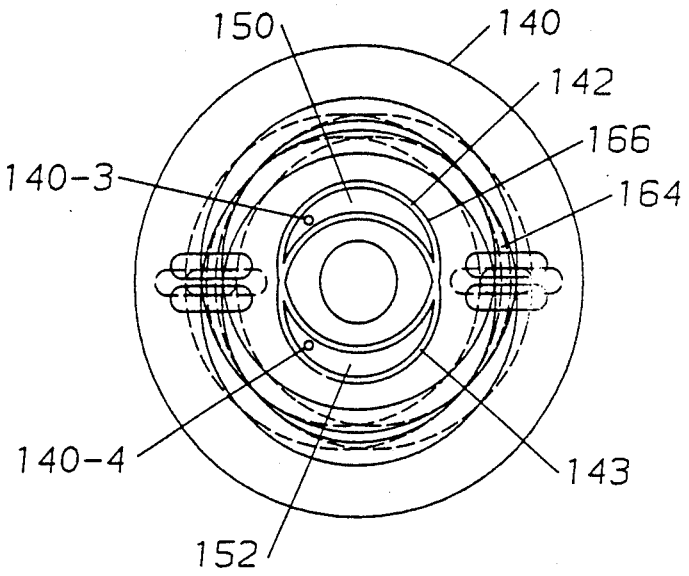
FIG. 4 is a view corresponding to FIG. 3 but showing a second embodiment of the invention.

In the FIG. 4 embodiment, two displaced circular grooves 142 and 143 in the form of interlocked rings are machined or otherwise suitably formed in crankcase 140 resulting in the formation of two crescent shaped pockets 150 and 152. The seal 166 is in the shape of two interlocked rings corresponding to grooves 142 and 143. All of the extreme positions of Oldham ring 164 are illustrated to show the available area for pockets 150 and 152. Fluid pressure would be supplied to pockets 150 and 152 via bores 140-3 and 140-4, respectively, in the same manner as the embodiment of FIGS. 1-3.

Figure 5:
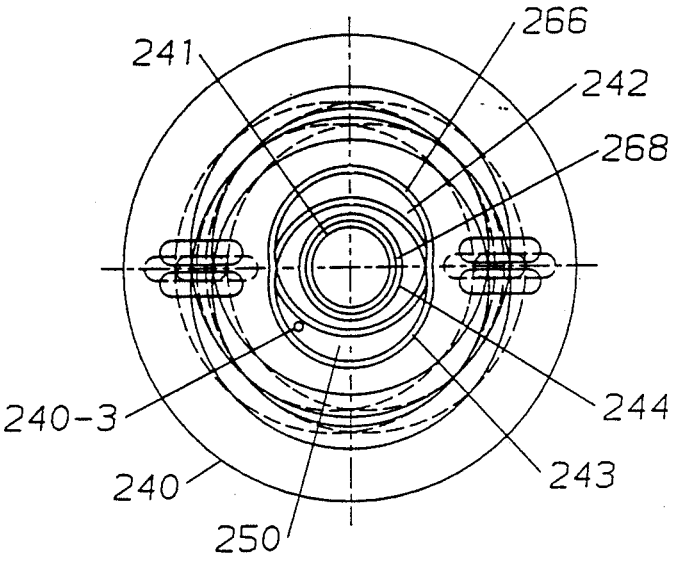
FIG. 5 is a view corresponding to FIG. 3 but showing a third embodiment of the invention.

In the FIG. 5 embodiment, there are two displaced circular grooves 242 and 243 in the form of interlocking rings, as in the FIG. 4 embodiment, plus a third circular groove 244 surrounding opening 241 in crankcase 240. The seal 266 is located only in the outermost portion of grooves 242 and 243 and seal 268 is in groove 244. As a result, there is a single annular pocket, 250, formed and defined by the area between seals 266 and 268. Because there is only one pocket, the fluid communication with pocket 250 can be by bore 240-3 but otherwise in the same manner as the embodiments of FIGS. 1"4. The location of bore 240-3 can be changed so that it is a vertical path rather than a slanted path in order to simplify machining.

Although preferred embodiments of the present invention have been illustrated and described, other changes will occur to those skilled in the art. For example, although discharge pressure is described as supplied to the pockets, intermediate pressure can be used. It is therefore intended that the scope of the present invention is to be limited only by the scope of the appended claims.

What is claimed:

1. Axial compliance means for a scroll compressor having a fixed scroll means, an orbiting scroll means in operative engagement with said fixed scroll means, crankcase means and anti-rotation means coacting with said orbiting scroll means and said crankcase means to limit said orbiting scroll means to orbiting motion comprising:

said crankcase means having a generally flat annular surface with a central opening therein with pocket means formed in said flat surface and groove means surrounding said pocket means with said groove means having an outer periphery having portions at varying distances from said central opening such that said outer periphery is at a non-uniform distance from said anti-rotation means so as to maximize said pocket means;

said means located in said groove means;

said orbiting scroll means movably engaging said seal means and coacting therewith to isolate said pocket means;

means for supplying pressurized fluid to said pocket means for providing an axial force to said orbiting scroll means.

2. The axial compliance means of claim 1 wherein said scroll compressor includes a crankshaft and said crankcase means overhangs said crankshaft whereby said pocket means can be located close to the portion of said orbiting scroll means subjected to the highest axial forces due to gas compression.

3. The axial compliance means of claim 1 wherein said pocket means is two pockets and said pocket means, groove means and seal means are generally kidney shaped and symmetrically located with respect to said central opening in said crankcase means.

4. The axial compliance means of claim 1 wherein said pocket means is a pair of crescent shaped pockets which meet each other at each of their ends and said seal means is shaped accordingly.

5. The axial compliance means of claim 1 wherein said groove means is in the form of two displaced interlocked rings [having a continuous] such that said outer periphery is continuous and a [common area with a] third ring within [said] a common area defined by said interlocked rings and spaced from each of said interlocked rings and said seal means is located only in the portion of said grooves means which is defined by said outer periphery and by said third ring.

6. A method for manufacturing axial compliance means for a scroll compressor having a fixed scroll, an orbiting scroll in operative engagement with said fixed scroll, crankcase and anti-rotation means coacting with said orbiting scroll and said crankcase to limit said orbiting scroll to orbiting motion comprising the steps of:

in a crankcase having a generally flat annular surface with a central opening therein, forming pocket means in the flat surface;

forming grooves means surrounding the pocket means with said groove means having an outer periphery having portions at varying distances from said central opening such that said outer periphery is at a non-uniform distance from said anti-rotation means so as to maximize said pocket means;

forming fluid path means in the crankcase terminating in the pocket means;

locating sealing means in the groove means;

securing the crankcase to a fixed scroll with said orbiting scroll therebetween and in engagement with the sealing means to thereby isolate said pocket means whereby when pressurized fluid is supplied to said pocket means via said fluid path means an axial force is provided to said orbiting scroll.

7. The method of claim 6 wherein the step of forming pocket means includes the forming of two kidney shaped pockets symmetrically located in the crankcase with respect to the central opening.

8. The method of claim 6 wherein the step of forming groove means includes the step of forming two displaced interlocking rings defining a pair of crescent shapes in which the pocket means are located.

9. The method of claim 6 wherein the step of forming groove means includes forming two displaced interlocked rings [having a continuous] such that the outer periphery is continuous and [encircling an area and forming] a third ring within [the] a common area defined by the interlocked rings and spaced from each of the interlocked rings and the step of locating sealing means in the groove means includes the locating of sealing means only in the portion of the groove means which is defined by the outer periphery and by the third ring.

* * * * *